US010794112B2

(12) United States Patent
Lambridis et al.

(10) Patent No.: US 10,794,112 B2
(45) Date of Patent: Oct. 6, 2020

(54) SLATTED DOOR WITH INCREASED IMPACT RESISTANCE

(71) Applicants: Andrew C. Lambridis, Dix Hills, NY (US); Ashraf Gomaa, Stony Brook, NY (US); Oscar Escobar, Glendale, NY (US); Vadim Litman, Kew Gardens, NY (US); Steven Anderson, Breezy Point, MN (US)

(72) Inventors: Andrew C. Lambridis, Dix Hills, NY (US); Ashraf Gomaa, Stony Brook, NY (US); Oscar Escobar, Glendale, NY (US); Vadim Litman, Kew Gardens, NY (US); Steven Anderson, Breezy Point, MN (US)

(73) Assignee: MCKEON ROLLING STEEL DOOR CO., INC., Bellport, NY (US)

( * ) Notice: Subject to any disclaimer, the term of this patent is extended or adjusted under 35 U.S.C. 154(b) by 273 days.

(21) Appl. No.: 16/032,939

(22) Filed: Jul. 11, 2018

(65) Prior Publication Data

US 2019/0390511 A1 Dec. 26, 2019

Related U.S. Application Data

(60) Provisional application No. 62/688,764, filed on Jun. 22, 2018.

(51) Int. Cl.

| | |
|---|---|
| ***E06B 9/15*** | (2006.01) |
| ***E06B 9/70*** | (2006.01) |
| *E06B 9/00* | (2006.01) |

(52) U.S. Cl.

CPC ..... *E06B 9/15* (2013.01); *E06B 9/70* (2013.01); *E06B 2009/005* (2013.01); *E06B 2009/1516* (2013.01); *E06B 2009/1544* (2013.01); *E06B 2009/1572* (2013.01); *E06B 2009/1583* (2013.01)

(58) Field of Classification Search

CPC ..... E06B 2009/1538; E06B 2009/1544; E06B 2009/1533; E06B 2009/1594; E06B 2009/1577; E06B 2009/1588; E06B 2009/1505; E06B 2009/1516; E06B 2009/1522; E06B 2009/135; E06B 9/11; E06B 9/15; E06B 9/08

USPC ..... 160/229.1, 235, 104, 133, 136, 232

See application file for complete search history.

(56) References Cited

U.S. PATENT DOCUMENTS 546,858 A * 9/1895 Kinnear ..... E06B 3/485 160/232
603,106 A * 4/1898 Kinnear ..... E06B 9/54 160/23.1
671,444 A * 4/1901 Kinnear ..... E06B 9/15 160/235
675,953 A * 6/1901 Kinnear ..... E06B 3/485 160/232

(Continued)

*Primary Examiner* — Johnnie A. Shablack

(74) *Attorney, Agent, or Firm* — Cozen O'Connor

(57) ABSTRACT

A slatted door includes a plurality of interengaged slats, and end members arranged at ends of respective slats. The end members and the slats are configured and arranged so that, when the slats are engaged with one another and with respective end members, at least one lateral reinforcement impact distribution structure is formed. The impact distribution structure is configured to absorb, distribute and/or redirect impact force in a direction along the length of the slats.

11 Claims, 16 Drawing Sheets

(56) References Cited

U.S. PATENT DOCUMENTS 800,249 A * 9/1905 Vance ..... E06B 3/485 160/232
827,677 A * 7/1906 Vance ..... E06B 3/485 160/232
830,456 A * 9/1906 Schultes ..... E05D 15/165 160/201
866,894 A * 9/1907 Vance ..... E06B 3/485 160/232
876,593 A * 1/1908 Rush ..... E06B 9/15 160/235
880,701 A * 3/1908 Vance ..... E06B 3/485 160/232
897,990 A * 9/1908 McCloud ..... E06B 9/15 160/235
994,440 A * 6/1911 Brunst ..... E06B 9/15 160/235
1,013,945 A * 1/1912 McCloud ..... E06B 3/485 160/232
1,014,315 A * 1/1912 McCloud ..... E06B 9/15 160/133
1,198,939 A * 9/1916 McDowell ..... E06B 9/15 160/235
1,352,656 A * 9/1920 Cahill ..... E06B 9/15 160/232
1,367,240 A * 2/1921 Cornell ..... E06B 9/15 160/235
1,406,303 A * 2/1922 Tomkinson ..... E06B 9/15 160/235
1,408,076 A * 2/1922 Claveria ..... E06B 9/15 160/229.1
1,437,947 A * 12/1922 Probert ..... E06B 9/15 160/235
1,579,915 A * 4/1926 Cornell ..... E06B 9/15 160/133
1,643,074 A * 9/1927 Lavagnino ..... E06B 9/15 160/235
1,707,287 A * 4/1929 Sudzki ..... E06B 9/15 160/232
1,720,850 A * 7/1929 Negrini ..... E06B 9/15 160/133
1,872,652 A * 8/1932 Best ..... E06B 9/115 160/232
1,908,634 A * 5/1933 Kendall ..... E06B 9/15 160/229.1
1,989,513 A * 1/1935 Greegor ..... E06B 9/581 160/41
2,019,379 A * 10/1935 Anderson ..... E06B 9/15 160/235
2,099,408 A * 11/1937 Packert ..... E06B 9/15 160/235
2,164,681 A * 7/1939 Fould ..... E04C 2/08 52/568
2,183,495 A * 12/1939 Laufersweiler ..... E06B 9/08 160/191
2,301,845 A * 11/1942 Anderson ..... E06B 9/15 160/235
2,898,988 A * 8/1959 Zoll ..... E06B 9/18 160/229.1
2,912,048 A * 11/1959 Grau ..... E06B 9/165 160/133
2,954,081 A * 9/1960 Recchione ..... E06B 9/17 160/219
3,067,814 A * 12/1962 Anthony ..... E06B 3/486 160/235
3,076,499 A * 2/1963 Zoll ..... E06B 9/15 160/41
3,076,500 A * 2/1963 Zoll ..... E06B 9/15 160/236
3,127,962 A * 4/1964 James ..... E04D 3/362 52/483.1
3,131,794 A * 5/1964 Bender ..... E04F 13/12 52/588.1
3,489,200 A * 1/1970 Recchione ..... E05D 15/24 160/133
3,712,258 A * 1/1973 Bauer ..... B63B 19/21 114/202
3,756,137 A * 9/1973 Scharres ..... F16K 17/38 160/1
4,173,247 A * 11/1979 Piana ..... E06B 9/165 160/220
4,223,503 A * 9/1980 Hague ..... E04D 3/362 52/394
4,282,920 A * 8/1981 Kremm ..... E06B 9/15 160/133
4,436,136 A * 3/1984 Downey, Jr. ..... E06B 3/485 160/232
4,470,444 A * 9/1984 Riexinger ..... E06B 9/15 160/235
4,532,973 A * 8/1985 DeFalco ..... B60J 5/14 160/201
4,628,982 A * 12/1986 Labelle ..... E06B 9/15 160/232
4,630,664 A * 12/1986 Magro ..... E06B 9/15 160/232
4,715,421 A * 12/1987 Erber ..... E06B 9/34 160/133
4,723,588 A * 2/1988 Ruppel ..... E06B 9/165 160/236
4,846,247 A * 7/1989 Kessler ..... E06B 9/15 160/235
4,972,894 A * 11/1990 Machill ..... E06B 9/15 160/235
4,979,553 A * 12/1990 Lowry, III ..... E06B 3/485 160/133
5,040,843 A * 8/1991 Russell ..... B60J 7/068 160/133
5,165,746 A * 11/1992 Teigen ..... B60J 5/08 160/201
5,246,054 A * 9/1993 Shepherd ..... E06B 9/17046 160/133
5,253,694 A * 10/1993 Bernardo ..... E06B 9/581 160/133
5,330,246 A * 7/1994 Bernardo ..... B60J 7/068 160/130
5,365,990 A * 11/1994 Ueda ..... E06B 9/15 160/133
5,419,386 A * 5/1995 Magro ..... E06B 9/15 160/232
5,515,902 A * 5/1996 Hoffman ..... E06B 9/165 160/235
5,673,740 A * 10/1997 Park ..... E06B 9/15 160/116
5,725,201 A * 3/1998 Parth ..... E04C 2/20 160/235
5,782,283 A * 7/1998 Kendall ..... E05D 15/24 160/229.1
5,921,308 A * 7/1999 Martin ..... E06B 3/485 160/229.1
6,068,040 A * 5/2000 Magro ..... E06B 9/581 160/133
6,129,132 A * 10/2000 Denoual ..... E05D 1/04 160/232
6,591,888 B2 * 7/2003 Benedetti ..... B23Q 11/085 160/122
6,631,749 B1 * 10/2003 Zabala ..... E06B 9/581 160/133
6,951,236 B2 * 10/2005 Schlater ..... E06B 9/581 160/133
7,100,665 B2 * 9/2006 Miller ..... E06B 9/581 160/133
7,357,171 B2 * 4/2008 Miller ..... E06B 9/15 160/133
7,464,743 B1 * 12/2008 Berger, Jr. ..... E06B 9/581 160/273.1
7,490,654 B2 * 2/2009 Gomaa ..... E06B 9/11 160/116
8,109,316 B2 * 2/2012 Wang ..... A62C 2/10 160/232

(56) References Cited

U.S. PATENT DOCUMENTS 8,376,020 B2 * 2/2013 Smart ..... E05D 15/266 160/199
9,211,833 B2 * 12/2015 Rusher ..... B60J 7/141
9,267,326 B2 * 2/2016 Gomaa ..... E06B 9/70
9,309,715 B2 * 4/2016 Miller ..... E06B 9/15
9,534,441 B2 * 1/2017 Allen ..... E06B 9/17
9,746,289 B2 * 8/2017 Hahn ..... F41H 5/045
9,915,094 B2 * 3/2018 Frede ..... E06B 9/17
10,041,291 B2 * 8/2018 Miller ..... E06B 9/11
10,253,557 B2 * 4/2019 Frede ..... E06B 9/15
10,344,527 B2 * 7/2019 Balbach ..... E06B 9/58
10,435,943 B2 * 10/2019 Rowley ..... E06B 9/171
2001/0035270 A1 * 11/2001 Erber ..... E06B 9/386 160/133
2003/0024659 A1 * 2/2003 Begni ..... E06B 9/15 160/235
2003/0047291 A1 * 3/2003 Klein ..... E06B 9/17076 160/133
2004/0188037 A1 * 9/2004 Schlater ..... E06B 9/581 160/133
2005/0205223 A1 * 9/2005 Miller ..... E06B 9/581 160/236
2006/0027346 A1 * 2/2006 Hsieh ..... E06B 9/11 160/232
2007/0131358 A1 * 6/2007 Iwasaki ..... E06B 9/58 160/133
2007/0137802 A1 * 6/2007 Lukasik ..... E06B 9/15 160/235
2007/0193701 A1 * 8/2007 Petrick ..... E06B 9/15 160/133
2009/0235602 A1 * 9/2009 Ceccofiglio ..... E06B 9/581 52/473
2012/0055637 A1 * 3/2012 Marinetti ..... E06B 9/15 160/133
2014/0053991 A1 * 2/2014 Miller ..... E06B 9/15 160/133
2015/0322711 A1 * 11/2015 Rowley ..... E06B 9/17007 160/133
2015/0361715 A1 * 12/2015 Frede ..... E06B 9/58 160/133
2015/0368962 A1 * 12/2015 Motosko ..... E04H 9/14 160/107
2017/0022753 A1 * 1/2017 Allen ..... E06B 3/486
2017/0067285 A1 * 3/2017 Lambridis ..... E06B 9/17046
2018/0044977 A1 * 2/2018 Bonnell ..... E06B 9/15
2019/0178032 A1 * 6/2019 McNabb ..... E06B 9/582
2019/0301237 A1 * 10/2019 Magro ..... E06B 9/165
2019/0390511 A1 * 12/2019 Lambridis ..... E06B 9/15

* cited by examiner

SLATTED DOOR WITH INCREASED IMPACT RESISTANCE

CROSS-REFERENCE TO RELATED APPLICATION

This application claims benefit under 35 U.S.C. § 119(e) of U.S. Provisional application No. 62/688,764, filed Jun. 22, 2018, the entirety of which is incorporated by reference herein.

BACKGROUND OF THE INVENTION

1. Field of the Invention

This application relates to doors, in particular, rolling or coiling slatted doors, such as safety doors.

2. Description of the Related Art

Slatted doors, that is, doors constructed out of a plurality of parallel slats, are known and commonly used in selective covering of openings in buildings, such as garages, entrances, etc. One problem with slatted doors is that they are vulnerable to damage and/or disengagement with the door frame, and/or individual slat when receiving an impact force or exposure to high pressures.

FIGS. 10A and 10B show a conventional door made of connected panels (also referred to as "slats") 820. With regard to the conventional panels 820, each panel 820 comprises a long side 870, inwardly facing sides 860 and 880, forming the bottom and the top of the panel 820, respectively, a lower hook 830 and an upper hook 840. The lower hook 830 of each panel 820 is configured to be able to engage, typically slidably engage, a corresponding upper hook 840 of the below adjacent panel. Conversely, the upper hook 840 of each panel is configured to engage the lower hook 830 of the above adjacent panel 820. A drawback of such prior art panels is that they are subject to being dislodged by an impact force or high pressure, such as is shown by the arrow in FIGS. 10A and 10B. As shown in FIG. 10B, the result of an impacting force F can cause the upper hook 840 to be dislodged from the lower hook 830 of the above adjacent panel 820, resulting in a failure of the door integrity.

For example, in hurricane or tornado conditions, debris may impact a door at speeds in excess of 100 miles per hour. One way to increase the strength of doors is to increase the thickness of the slats. However, this has the disadvantage of increasing the weight of the door, which affects cost as well as other parts of the door assembly. For example, the power of the motor required to lift and close the door would need to be increased. There is therefore a need for a slatted door that can withstand extreme weather conditions without the use of slats of increased weight.

SUMMARY OF THE INVENTION

According to one aspect of the present invention, a door assembly for covering an opening defined by at least one structural element of a building includes: a shutter roller positioned proximate the opening and rotatable about an axis of rotation; a drive mechanism configured to rotate the shutter roller about the axis of rotation; a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door; a guide rail assembly positioned at each side of the opening and extending along the direction of travel of the door; and a plurality of end members each attachable to an end of a corresponding slat, the first edge and second edge each having a hook portion terminating in a hook face, the hook face being one of substantially parallel to, and forming an acute angle with, the outward face of the door. At least when a first slat is connected at the hook portion of its first edge with the hook portion of the second edge of an adjacent slat, the first and adjacent slats engage along their edges to form a reinforcement impact distribution structure extending laterally along the length of the slats. The impact distribution structure is configured to: (a) rotatably secure the first and second slats to one another, and (b) direct an impact force applied to the outward face of the door in a direction substantially along the length of the one or more slats.

In another aspect, the door is a single side profile door formed of a plurality of front panel slats.

In another aspect, adjacent slats are connected by slidable engagement.

In another aspect, the hook face forms an acute angle with the outward face of the door.

In another aspect, the hook face of the hook portion of the first edge forms a first acute angle with the outward face of the door and the hook face of the hook portion of the second edge forms a second acute angle with the outward face of the door.

In another aspect, the first acute angle and the second acute angle are substantially equal.

In another aspect, the hook face comprises a turned back portion that is configured to securely engage with the hook of an adjacent slat.

In another aspect, the hook face is substantially parallel with the outward face of the door.

In another aspect, each end member at least partially overlaps with an adjacent end member.

In another aspect, each end member at least partially overlaps with, and is connected to, an adjacent end member.

In another aspect, the hook face comprises a right angle portion configured to securely engage with the hook of an adjacent slat.

According to another aspect of the present invention, a door assembly for covering an opening defined by at least one structural element of a building includes: a shutter roller positioned proximate the opening and rotatable about an axis of rotation; a drive mechanism configured to rotate the shutter roller about the axis of rotation; a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door; a guide rail assembly positioned at each side of the opening and extending along the direction of travel of the door; and a plurality of end members each attachable to an end of a corresponding slat, the first edge and second edge each having a hook portion. The first edge of each slat is configured as a protrusion and the second edge of each slat is configured to have a recess such that when the upper edge of a slat is engaged with the lower edge of an adjacent above slat, the protrusion is received in the recess, and the protrusion and recess form a reinforcement impact distribution structure extending laterally along the length of the slats.

In another aspect, the door is a double sided profile door and each slat of the door comprises a front panel and an associated back panel.

In another aspect: each front panel comprises the first hook portion and the second hook portion, and each back panel comprises a back panel first hook portion and a back panel second hook portion, the first hook portion of each front panel being configured to engage a corresponding second hook portion of the front panel of the adjacent slat, and the second hook portion of each front panel being configured to engage the first hook of the front panel of a second adjacent slat, the second hook portion of each front panel being configured to engage the back panel second hook portion of the corresponding back panel, the first hook portion of each front panel being configured to engage the back panel first hook portion of the corresponding back panel, the engaged first hooks of each slat of the double side profile door engage the engaged second hooks of a below adjacent double profile slat, and the engaged second hooks of each slat of the double side profile door engage the engaged first hooks of an above adjacent double profile slat.

In another aspect, each end member at least partially overlaps with an adjacent end member.

In another aspect, each end member at least partially overlaps with, and is connected to, an adjacent end member.

According to another aspect of the present invention, a door assembly for covering an opening defined by at least one structural element of a building includes: a shutter roller positioned proximate the opening and rotatable about an axis of rotation; a drive mechanism configured to rotate the shutter roller about the axis of rotation; a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door; a guide rail assembly positioned at each side of the opening and extending along the direction of travel of the door; a plurality of end members each attachable to an end of a corresponding slat; and at least one stiffening insert affixed to, and positioned proximate, an inner side of the outward face, and arranged in a direction along the length of the at least one slat. The at least one stiffening insert forms a lateral reinforcement impact distribution structure configured to distribute and redirect an impact force applied to one or more of the slats of the door in a direction substantially along the length of the one or more slats.

In another aspect, the door assembly further includes, in the end members, insert brackets, each having at least one opening to accept and secure one end of a respective stiffening insert.

In another aspect, the door is a single side profile door made up of a plurality of front panel slats.

In another aspect, each front panel slat comprises an upper hook and a lower hook, wherein the lower hook of each slat is configured to engage a corresponding upper hook of the below adjacent slat, and wherein the upper hook of each slat is configured to engage the lower hook of the above adjacent slat.

In another aspect, the door is a double side profile door and wherein each slat of the door comprises a front panel and an associated back panel.

In another aspect: each front panel comprises the lower hook and the upper hook, and each back panel comprises a back panel lower hook and a back panel upper hook, the lower hook of each front panel being configured to engage a corresponding upper hook of the front panel of the below adjacent slat, and the upper hook of each front panel being configured to engage the lower hook of the front panel of above adjacent slat, the upper hook of each front panel being configured to engage the back panel upper hook of the corresponding back panel, the lower hook of each front panel being configured to engage the back panel lower hook of the corresponding back panel, the engaged lower hooks of each slat of the double side profile door engages the engaged upper hooks of a below adjacent double profile slat, and the engaged upper hooks of each slat of the double side profile door engages the engaged lower hooks of an above adjacent double profile slat.

In another aspect, each end member at least partially overlaps with an adjacent end member.

In another aspect, each end member at least partially overlaps with, and is connected to, an adjacent end member.

According to another aspect of the present invention, a door assembly for covering an opening defined by at least one structural element of a building includes: a shutter roller positioned proximate the opening and rotatable about an axis of rotation; a drive mechanism configured to rotate the shutter roller about the axis of rotation; a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door, wherein when a first slat is engaged with a second adjacent slat, portions of the first and second adjacent slats engage one another; a guide rail assembly positioned at each side of the opening and extending along the direction of travel of the door; and a plurality of end members each attachable to an end of a corresponding slat. Each of the end members has an anchor affixable to an end of one of the slats, and a force dampening member offset from the anchor, each force dampener at least partially overlapping a force dampener of an adjacent end member at a spacing to absorb shock applied to one or more of the slats of the door in a direction substantially along the length of the one or more slats.

In another aspect, the overlapping portions of the force dampeners are affixed to one another.

In another aspect, the first edge and second edge each have a hook portion terminating in a hook face, the hook face being one of substantially parallel to, and forming an acute angle with, the outward face of the door, wherein at least when a first slat is connected at the hook portion of its first edge with the hook portion of the second edge of an adjacent slat, the first and adjacent slats engage along their edges to form a reinforcement impact distribution structure extending laterally along the length of the slats, and wherein the impact distribution structure is configured to: (a) rotatably secure the first and second slats to one another, and (b) direct an impact force applied to the outward face of the door in a direction substantially along the length of the one or more slats.

In another aspect, the first edge of each slat is configured as a protrusion and the second edge of each slat is configured to have a recess such that when the upper edge of a slat is engaged with the lower edge of an adjacent above slat, the protrusion is received in the recess, and the protrusion and recess form a reinforcement impact distribution structure extending laterally along the length of the slats.

In another aspect, the door assembly further includes: at least one stiffening insert affixed to, and positioned proximate, an inner side of the outward face, and arranged in a direction along the length of the at least one slat, wherein the at least one stiffening insert forms a lateral reinforcement impact distribution structure configured to distribute and redirect an impact force applied to one or more of the slats of the door in a direction substantially along the length of the one or more slats.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

Further advantageous configurations of the invention are also stated in the following description of exemplary embodiments on the basis of figures. Useful combinations and developments which are within the ability of a person skilled in the art are likewise within the scope of the invention.

DETAILED DESCRIPTION OF THE PRESENTLY PREFERRED EMBODIMENTS

Figure 1A:
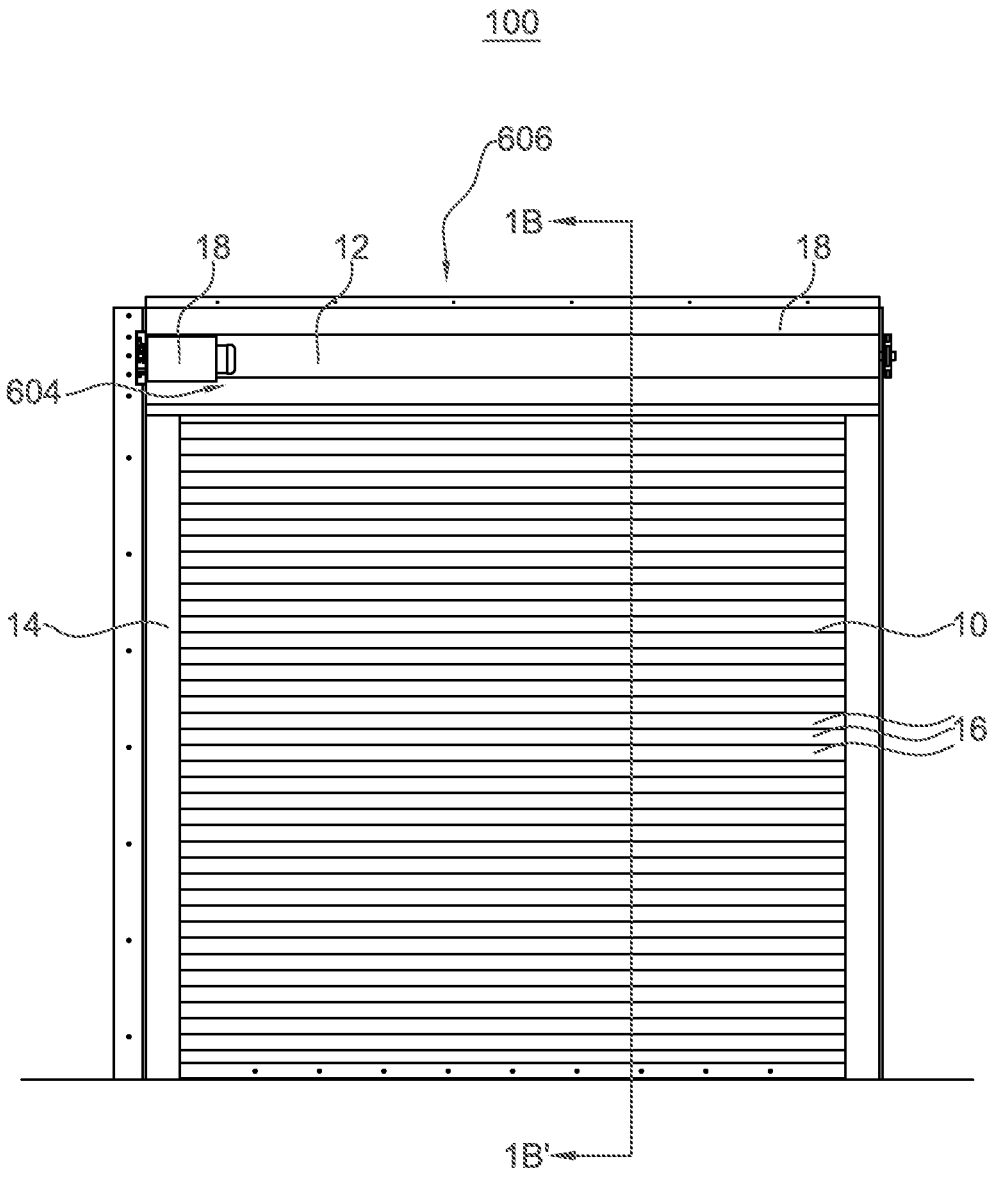
FIGS. 1A and 1B are front elevational and side views, respectively, of a slatted door in accordance with the present invention.
Figure 1B:
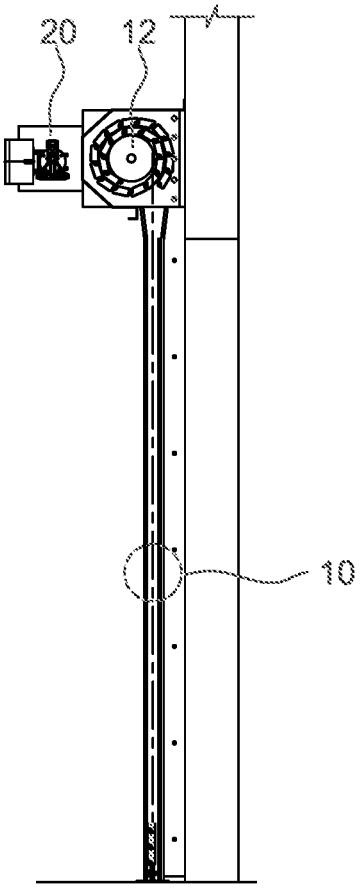

As shown in FIGS. 1A to 1B, a vertical coiling door 100 configuration comprises a door/curtain 10 having a fixed end affixed to a horizontally oriented coil pipe 12 located along the top of the vertical coiling door 100, and a free end, such that the door can roll onto and off of the pipe 12, as is known in the art. Guide tracks 14 extend vertically along each edge of the door/curtain 10 to form channels that permit the door/curtain 10, and more particularly ends of slats 16 forming the door/curtain 10, to be guided therein to allow the door to move between a closed and an open position. When the door 100 is in the open position, the door/curtain 10 may be maintained, rolled up partially or entirely on the coil pipe 12. To close the door/curtain 10, rotational force is applied from a motor 18 to the coil pipe 12, for example by a belt/chain 20, to unspool the wound door/curtain 10 from the coil pipe 12.

As shown in FIGS. 1A and 1B, in a vertical coiling door configuration, the door/curtain 10 is opened and closed by operation of a drive unit 604, preferably enclosed in a drive unit housing 606 which, in the illustrated embodiment, extends across the top portion of the vertical coiling door. The drive unit 604 includes a motor 18 configured to set the coil pipe 12 in motion in either a clockwise or counter-clockwise direction. The motor 18 drives the coil pipe 12 using a belt or chain 20. The motor 18 can be any standard motor operator, to drive the coil pipe 12 in the required directions, e.g., the clockwise and counter-clockwise. The coil pipe 12 is configured to rotate in one direction to un-coil the door/curtain 10, when closing the door/curtain 10, and in the opposite direction when retracting the door/curtain 10 to an open position. The coil pipe 12 preferably extends the entire width, from one lateral side of the door/curtain 10 to the other lateral side, along the top of the vertical coiling door. In the open (i.e., retracted) position, the door/curtain 10 is substantially wrapped around the coil pipe 12 for secure storage.

FIG. 1A is an elevational view of the vertical coiling door configuration that utilizes the inventive features of the present invention, and FIG. 1B is a view taken along section 1B-1B'. In the vertical coiling door configuration, two guide tracks 14 are provided, one proximal to each lateral edge of door/curtain 10. Each guide track 14 is affixed to a structural support, for example, a portion of a wall of a building in which the vertical coiling door is installed, for example a masonry wall.

Figure 2:
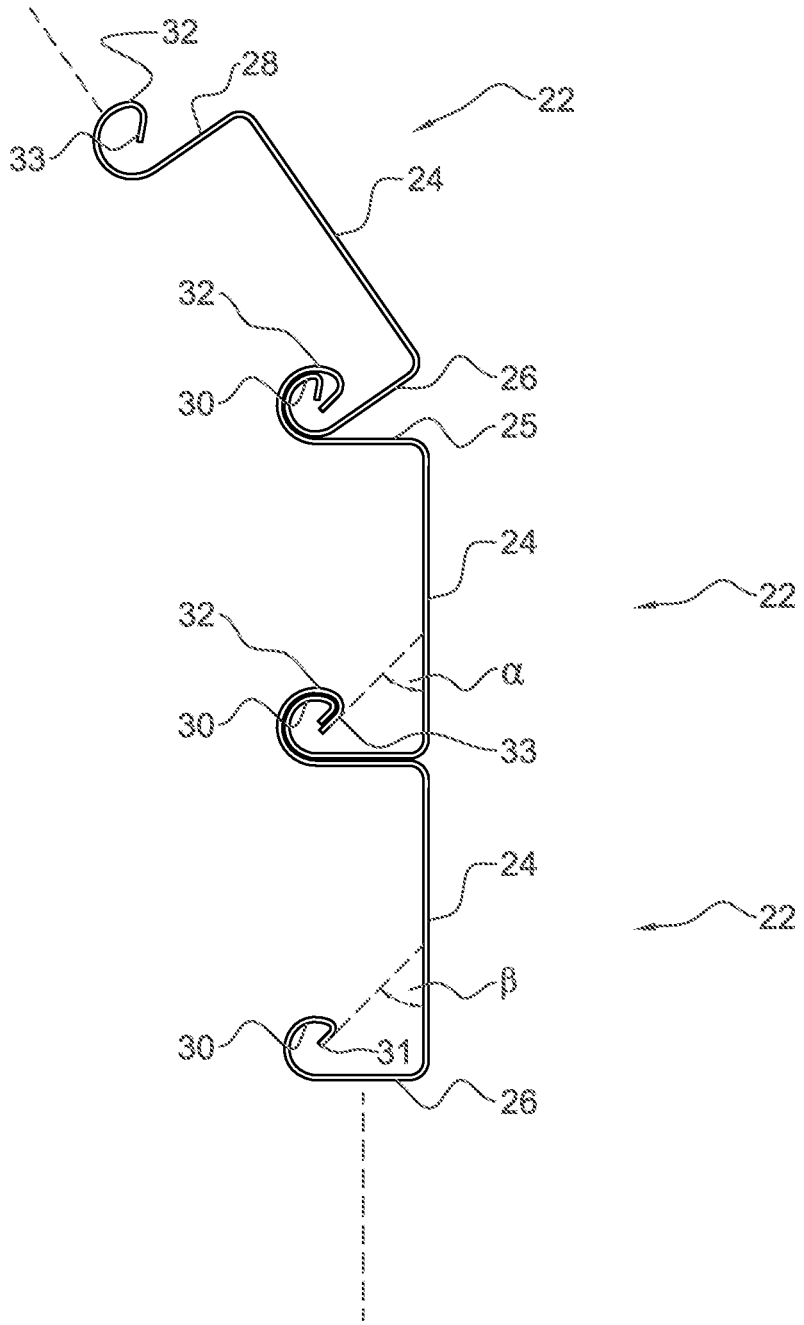
FIG. 2 is a section view of a portion of a single side profile door in accordance with an aspect of the present invention employing a retaining hook.

FIG. 2 is a cross-sectional view of three exemplary interconnected front panel slats 22 of a door. In this embodiment, the slats 22 form the front, i.e., outward facing, portion of the door 10. As will be discussed in greater detail below, the slats making up the door may be formed by only front panel slats, in this example retaining hook front panel slats 22. Such a configuration for the door 10 will be referred to generally as a single-side profile door. Another option, to be discussed in more detail below, is for a double-side profile door where the door is made up of double side profile slats, each side of the double-side profile door comprising a front panel, such as, for example, a panel similar to the retaining hook front panel slat 22, and a back slat, which engages a corresponding front panel. FIG. 2 illustrates three representative retaining hook front panel slats 22, with the lower two in a flat configuration, and the top one angled (i.e., for unwinding or wind up the door). In all of the disclosed embodiments, the various panels, or slats, typically engage with upper and lower adjacent slats by a slidable engagement with each other.

As can be seen from FIG. 2, each retaining hook front panel slat 22 comprises a front face 24, inwardly facing sides 26 and 28 forming the bottom and the top of the slat 22, respectively, a lower hook 30 and an upper hook 32 and respective edges of the slat 22. As can be seen best from an examination of the middle slat 22, the lower hook 30 of each slat 22 is configured to engage, typically slidably, a corresponding upper hook 32 of the below adjacent slat. Conversely, the upper hook 32 of each slat is configured to engage, typically slidably, the lower hook 30 of the adjacent slat.

In an advantageous feature in accordance with an aspect of the present invention, the upper hook 32 in each retaining hook front panel slat 22 has a turned back portion 33 configured as a flat hook face forming an acute angle ($\alpha$) with the outward face of the door. This turned back portion 33 prevents an impacting force into the front of the door from dislodging the slats from one another. In addition, the lower hook 30 also has a flat turned back portion 31 also configured as a hook face forming an acute angle ($\beta$) with the face 24 of the door. Preferably, the angles $\alpha$ and $\beta$ are substantially equal such that the turned back portion 33 and the turned back portion 31 overlap and are in contact with each other. This configuration results in the upper hook 32 securely engaging the corresponding lower hook 30, by preventing motion of the slats inwardly from the front side 22. In contrast, a door formed with conventional slats, i.e., without the turned back portions 31, 33 would be more likely to have slats disengage from each other when receiving an impact force to the face 24 of the door. The engaged hooks of retaining hook front panel slats 22 shown in FIG. 2 form a lateral reinforcement impact distribution structure, distributing impact forces in a direction along the slat length. When the hooks form such lateral reinforcement impact distribution structures, the door slats are less likely to separate from each other, and are less likely to be dislodged from the guide tracks, when the door is impacted by debris or the like. Thus, such configurations result in an improved robust door.

Figure 3:
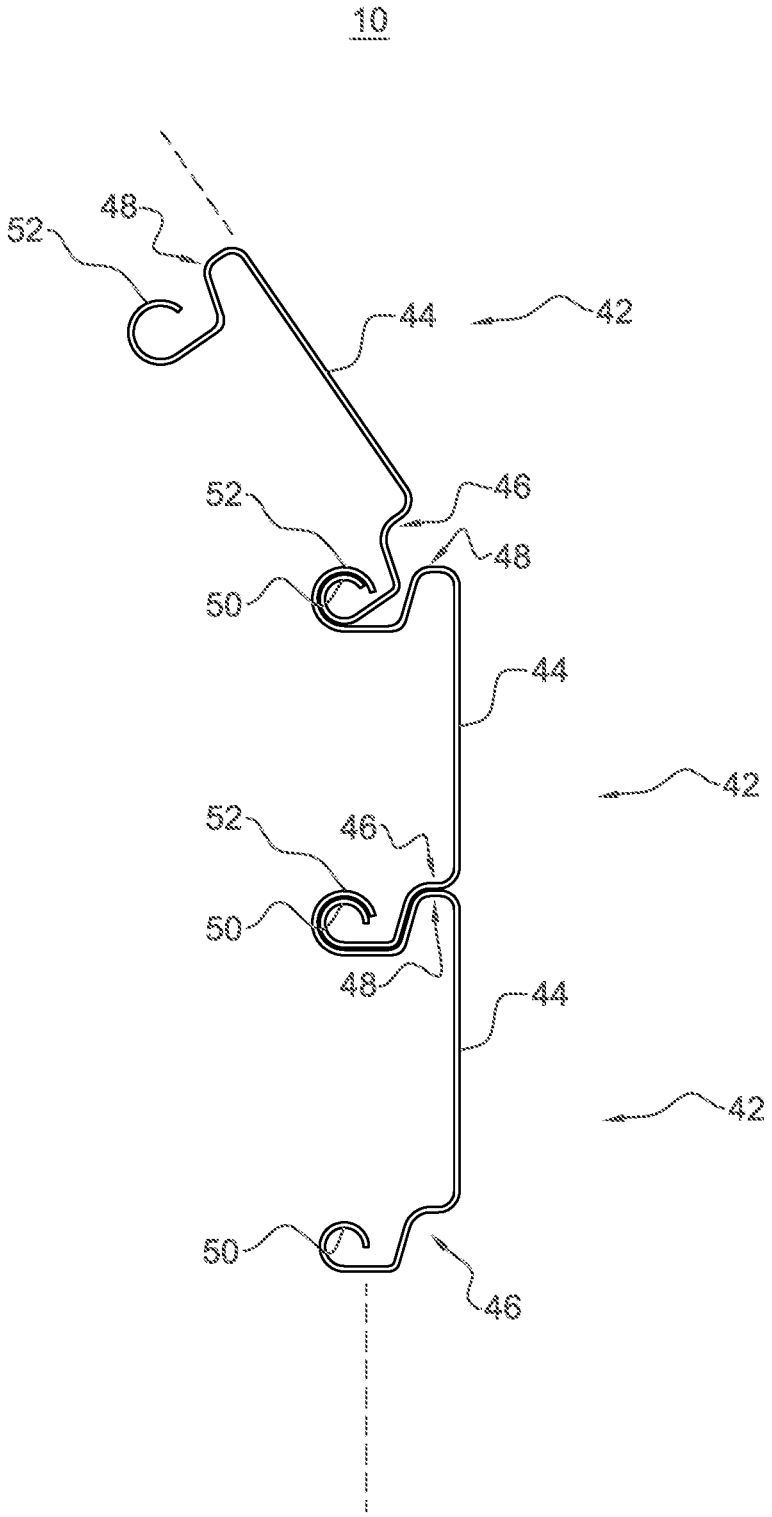
FIG. 3 is a section view of a portion of a second single side profile door in accordance with another aspect of the present invention with an offset feature.

FIG. 3 is a cross-sectional view of three exemplary interconnected double offset front panel slats 42 of a door 10. In this embodiment, the slats 42 form the front, i.e., outward facing, portion of the door 10. Just as was the case in FIG. 2, the slats making up the door may be formed by only front panel slats, such as double offset front panel slats 42, to form a single-side profile door. Just as was the case in the discussion regarding FIG. 2, another option, to be discussed in more detail below, is for the door to be made up of front panel slats, such as, for example, double offset front panel slats 42, and a back slat, each of which engages, typically slidably, its corresponding front panel slat. FIG. 3 illustrates how double offset front panel slats 42 connect to one another to form a single-side profile door.

As can be seen from FIG. 3, each double offset front panel slat 42 comprises a front face 44, inwardly facing offset sides 46 and 48 comprising a recess formed at the bottom edge, and a protrusion formed at the top edge of the slat 42, respectively, a lower hook 50 and an upper hook 52. As can be seen best from an examination of the middle slat 42 in FIG. 3, the lower hook 50 of each slat 42 is configured to engage a corresponding upper hook 52 of the below adjacent slat. Conversely, the upper hook 52 of each slat is configured to engage the lower hook 50 of the above adjacent slat 42.

The inwardly facing offset sides 46 and 48 of FIG. 3 differ from the offset sides 26 and 28 of the retaining hook front panel slat 22 of FIG. 2. In FIG. 3, the double offset front panel slat 42 includes the protrusion 48 in the upper edge proximate hook 52, and the recess 46 proximate hook 50. This profile provides a force dissipation configuration between adjacent slats. That is, when the upper hook 52 of a slat 42 engages the lower hook 50 of an adjacent slat 42, the offset side or protrusion 48 and the offset side or recess 46 nestle into one another, as can be seen, for example, at the top of the lowest slat 42 in FIG. 3. When nestled together, the respective profiles of the offset side 48 and the offset side 46 form a reinforcing structure that distributes a force impacting the front face 42 of the door, to decrease the likelihood that the adjacent slats will disengage from one another.

As was the case in the turned back hook feature of the slats 22 shown in FIG. 2, the engaged hooks of adjacent offset slats 42 shown in FIG. 3 form a lateral reinforcement impact distribution structure, distributing impact forces in a direction along the slat length. When the hooks form such lateral reinforcement impact distribution structures, the door slats are less likely to separate from each other, and are less likely to be dislodged from the guide tracks, when the door is impacted by debris or the like. Thus, such configurations result in an improved robust door.

FIGS. 4A to 4D show a force distribution chain assembly 57 and illustrate how such an assembly 57 engages with a single-side slat profile door 10. Force distribution chain assembly 57 comprises a series of end members, each of which is attached to an end of a door slat. In some configurations, the end members may be attached to adjacent end members, although it is not a requirement that the end member be attached to other end members.

More importantly, each end member has an extending portion in a direction away from the front side (e.g., 44) of the slats 22, in the illustrated embodiment a horizontally extending portion 63 (force dampener). Each portion 63 is configured to overlap an adjacent extending portion 63 of an adjacent slat. The overlap portions can be coupled to each other or simply arranged in an overlap configuration with sufficient spacing such that a force applied to the front 44 of a slat (i.e., a "subject slat") will travel to the associated end member, to the extending portion and then, as a result of the direct coupling or close proximity arrangement, to the extending portions 63 of slats adjacent the subject slat. This arrangement provides a force dampening effect.

The end members can be in the form of a windlock 60 or an endlock 61. As will be described below, the difference between a windlock 60 and an endlock 61 is an additional structure, referred to as a windlock wing member 62, which engages the railing of the guide track 14 to prevent excessive bowing of the door 10 which could cause disengaging of the door from the railing.

For the sake of simplicity, each instance of the single slat in the door 10 will be numbered 22 representing the retaining hook front panel slat 22. However, as would be clear to one of ordinary skill in the art, the single slats could instead be the double offset front panel slat 42, or even conventional slats, as these types of slats interface similarly with the chain assembly 57 of the present invention.

Figure 4A:
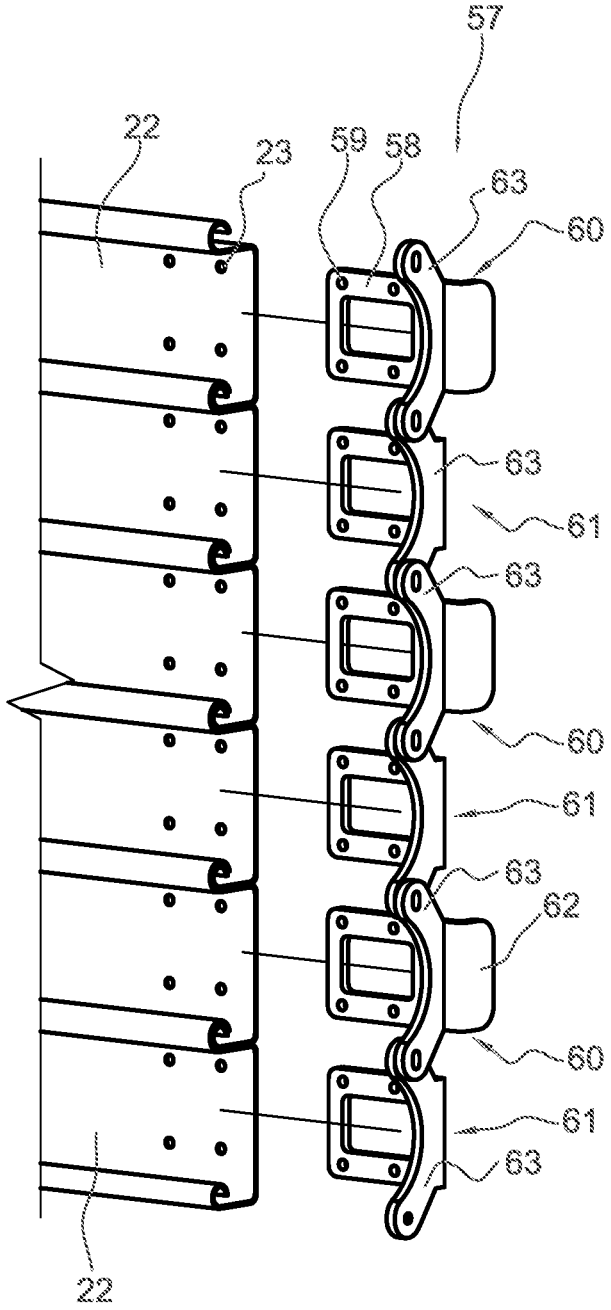
FIGS. 4A-4D are views of slats of a single side profile door engaging with a chain assembly in accordance with an aspect of the present invention.

FIG. 4A is an exploded view of an end of the door 10, made up of a plurality of front panel slats 22, and the chain assembly 57 to which the end of the door 10 is to be connected. The ends of each slat 22 have mounting holes 23 which, when the front panel slats 22 and the chain assembly 57 are lined up for connection, rivet holes 59 in a rectangular portion 58 of each windlock 60 and each endlock 61 are aligned. Each windlock 60 and endlock 61 also has a horizontally extending portion 63. The only difference between an endlock 61 and a windlock 60 is, in the case of the latter, a wing member 62 is also provided. The windlock wing member 62 engages the railing of the guide track 14 to prevent excessive bowing of the door 10 which could cause disengaging of the door from the railing. While the figure show an alternating configuration of windlocks 60 and endlocks 61, such alternating arrangement is not required. In fact, for the purposes of lateral force distribution in the case of frontal impact, the door will work equally well with different numbers and percentages of windlocks and endlocks. The chain assembly 57 can have an arrangement of these, or all of one type lock, or all of the other type lock.

Figure 4B:
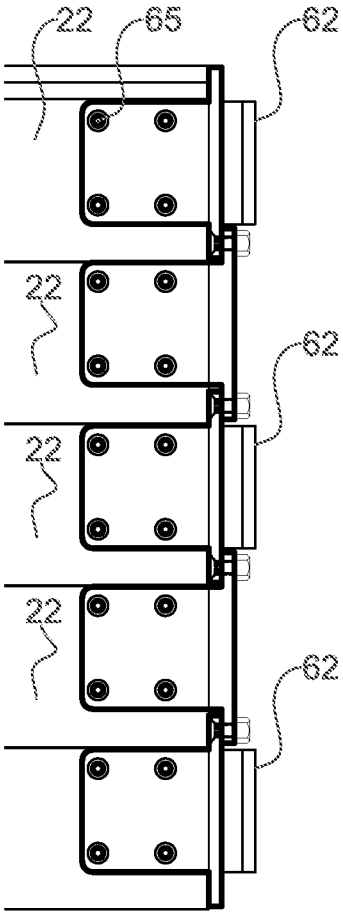

FIG. 4B shows the front panel slats 22 affixed to the chain assembly 57 by the use of rivets 65 attached through the aligned holes 23 and 59. As best seen in the side view of FIG. 4C, in the illustrated example utilizing alternating endlocks 61 and windlocks 62, each of the windlocks 60 is pivotally connected to an adjacent endlock 61 by a bolt 67. The connection is sufficiently secure to maintain the structural integrity of the door 10, while still allowing the door slats to rotate between a flat position when the door is employed, to a curved position when the door is rolled on barrel 12. However, as discussed above, the chain assembly 57 does not necessarily need to have alternating endlocks and windlocks and may have different configurations and arrangements of these elements, including only endlocks, only windlocks, or any combination.

Figure 4C:
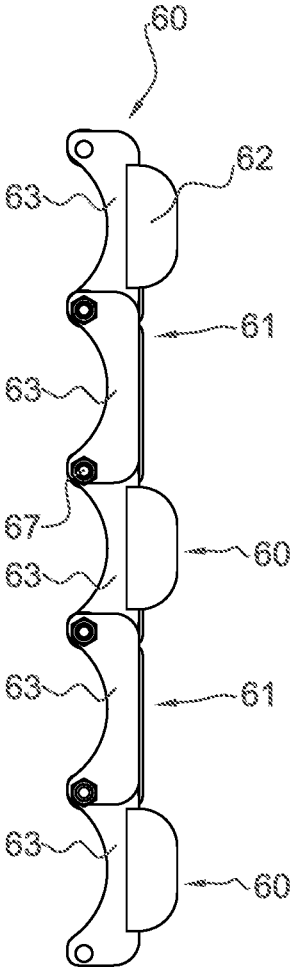
Figure 4D:
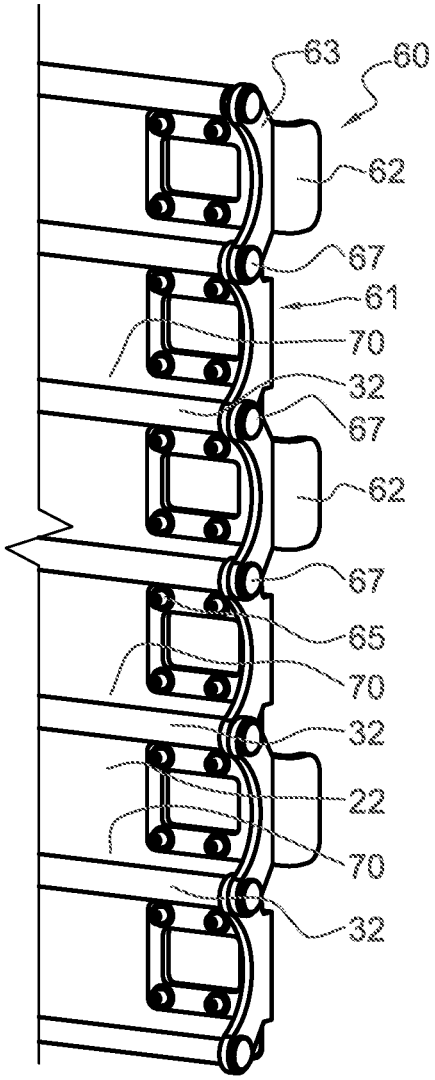

FIG. 4D is a perspective view of the assembly shown in FIG. 4C and shows an upper hook 32 of each of the slats 22. It can be seen in this view that the upper hook 32 engaged with the lower hook 30 as shown in FIG. 2 together form a strengthening member 70 that extends along the lateral direction of the door 10. This member 70 provides a lateral reinforcement impact distribution structure configured to rotatably secure adjacent portions of the first and second slats 22 with one another, and to absorb, distribute and redirect impact transverse to the direction of lateral extension of the slatted door 10 to the direction along the length of the slats 22.

Although the use of hook slats 22 will provide the advantages mentioned above with respect to that type of slat, the overlapping of the horizontally extending portion 63 of the various adjacent windlocks and endlocks, regardless of the type of slat, also provides an impact distribution benefit by dispersing impact forces applied to the door slats.

This is so even if the ends of the horizontally extending portions are not connected, e.g., bolted, to one another, but are simply in close proximity to each other. This is because the overlap of the ends of the horizontally extending portions 63 absorbs and dissipates to adjacent extending portions any impact force that travels in the lengthwise direction of the slat. Thus, although embodiments are shown herein in which the ends of the horizontally extending portions 63 are shown as being connected with, e.g., bolts, the overlap of the horizontally extending portions 63 alone, i.e., without being bolted together, will also provide distribution of an impact force to adjacent slats.

Another variation of the door according to the present invention is similar to the door 10 discussed with respect to FIGS. 1A to 4D but with a double slat profile. That is, the door in the thickness direction, instead of comprising only front panel slats, like slats 22 and 42, has a double slatted construction, i.e., a construction in which each slat of the door is comprised of a front panel and an associated back panel.

In all of the slat profiles in the present invention, the ends of the slats can use the chain assembly 57 like that shown in FIG. 4D. Moreover, the invention is not limited to alternating windlocks and endlocks. For example, the chain assembly 57 can consist of only windlocks, only endlocks, or different arrangements of windlocks and endlocks other than an alternating arrangement.

FIGS. 5A to 5D show components of a double-sided door 10 having slats of a retaining hook double slat profile. That is, each slat is formed from not only a front panel, in this case 220, but also from a back panel 500.

Figure 5A:
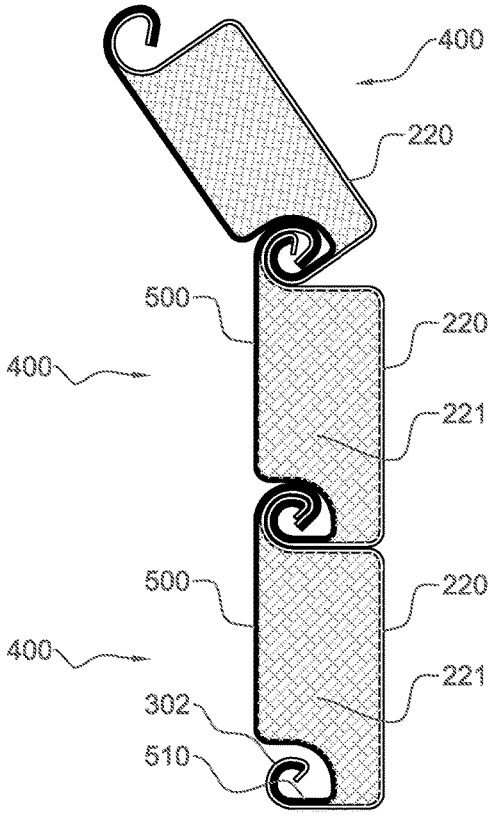
FIGS. 5A-5D illustrate components of a double side profile door in accordance with an aspect of the present invention.

FIG. 5A is a cross-sectional view of three exemplary interconnected retaining hook double slat profile panel slats 400 of a door 10. In this embodiment, each retaining hook double slat profile 400 has a retaining hook front panel 220 forming the front, i.e., outward facing, portion of the retaining hook double slat profile 400, and a back slat or panel 500, forming the back, i.e., rearward facing, portion of the retaining hook double slat profile 400.

Figure 5C:
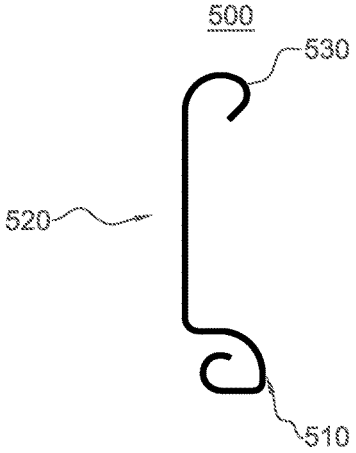
Figure 5B:
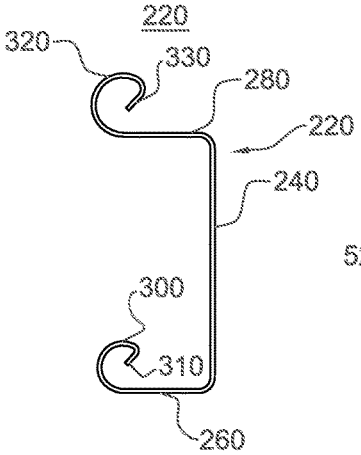

As can be seen FIG. 5A, and FIG. 5B, each front panel 220, has a respective back panel 500, shown in isolation in FIG. 5C, each of which engages its corresponding front panel. FIG. 5A shows how retaining hook front panels 220 connect to one another, and to corresponding back panels 500, to form a representative portion of a double-side profile door.

Substantially the same as is the case with regard to the front panel slat 22 shown above with regard to FIG. 2, each retaining hook front panel 220 comprises a front side 240, inwardly facing sides 260 and 280, forming the bottom and the top of the front panel 220, respectively, a lower hook 300 and an upper hook 320. As can be seen best from an examination of the front panel 220 of the middle retaining hook double slat profile slat 400 in FIG. 5A, the lower hook 300 of each front panel 220 is configured to engage a corresponding upper hook 320 of the below adjacent slat. Conversely, the upper hook 320 of each front panel is configured to engage the lower hook 300 of the above adjacent slat. As can be seen from the figure, each retaining hook front panel 220 contains a turned back portion 330, associated with the upper hook 320, and a turned back portion 310, associated with the lower hook 300.

A difference between a single slatted door and a double slatted door is that the front panels not only engage with adjacent front panels, but also with their respective back panel 500. Also, as will be discussed below, this combination of upper hooks of each retaining hook double slat profile slat 400 engages a combination of lower hooks.

Figure 5D:
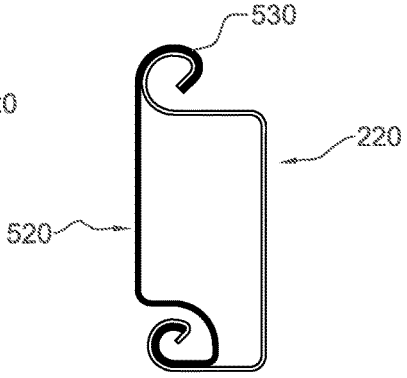

The back panel 500 is shown isolated in FIG. 5C. Each back panel 500 includes a lower hook 510, a long portion or face 520, and retaining hook 530. As can be seen in FIG. 5A, for each double slat profile slat 400, the interconnected top hooks 320 and 530 are connected to one another and to the interconnected bottom hooks 300 and 510 of the double slat profile slat 400 immediately above. FIG. 5D shows a view of the back panel 500 and front panel 220 assembled to each other to form the double slat profile slat 400 as discussed above.

Each double sided slat can optionally have an insulation core 221. While this configuration has certain advantages, for example an implementation of insulation or fireproofing, it is not a necessary element of the present invention.

Figure 6A:
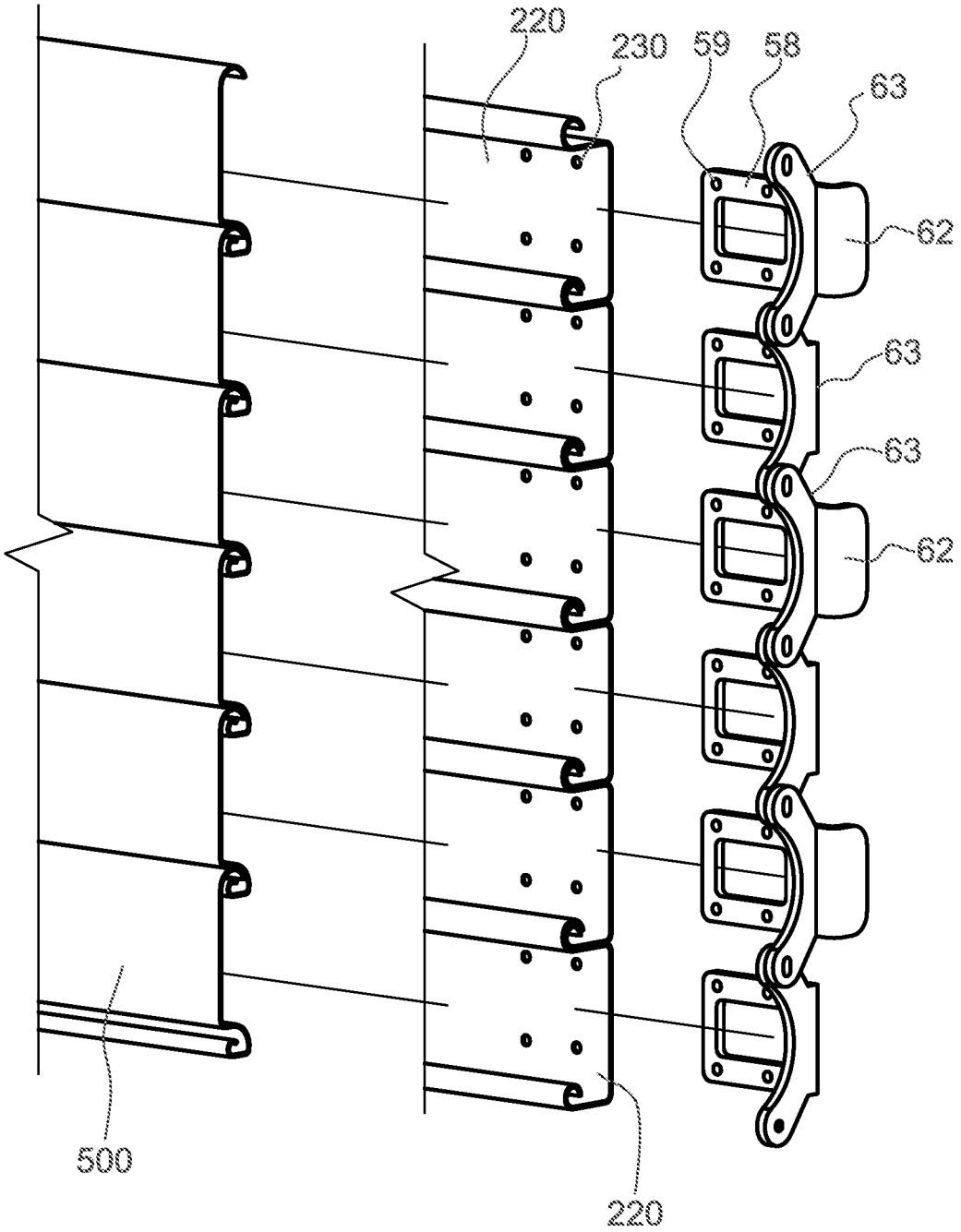
FIGS. 6A and 6B are views of slats of a double side profile door engaging with a chain assembly in accordance with an aspect of the present invention.

FIG. 6A is an exploded view of an end of the door 10, made up of a plurality of front panels 220, back panels 500, and a chain assembly 57 to which the end of the door 10 is to be connected. The ends of each front panel 220 have connecting holes 230 which, when the front panels 220 and the chain assembly 57 are lined up for connection, line up with rivet holes 59 in a rectangular portion 58 of each windlock 60 and each endlock 61. As discussed above, the main difference between an endlock 61 and a windlock 60 is the presence, in the each windlock 60, of wing member 62. The windlock wing member 62 engages the railing of the guide track 14 to prevent excessive bowing of the door 10 which could result in the door disconnecting from the railing.

Figure 6B:
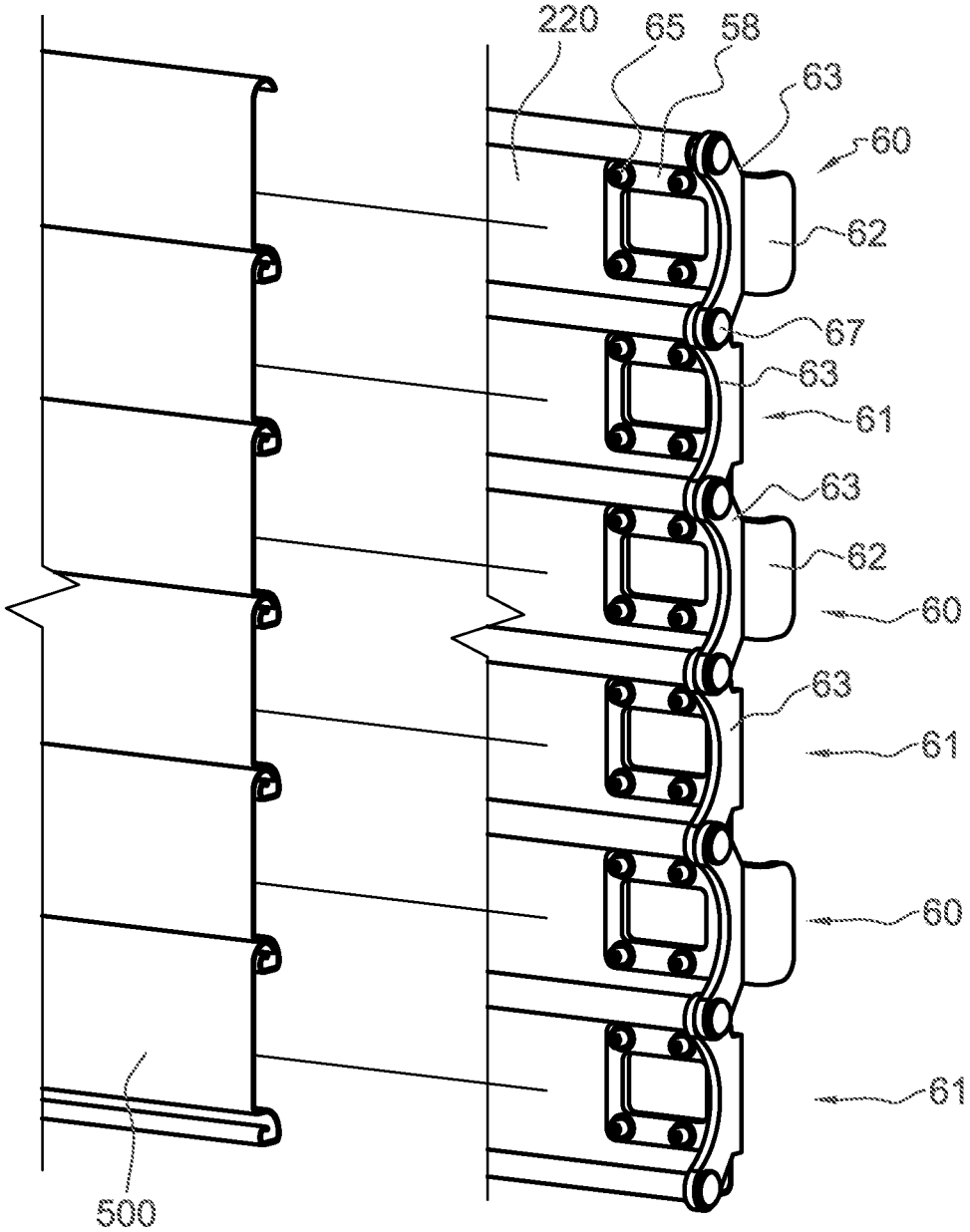

FIG. 6B is an exploded view of a partially assembled double slatted door, with the front panels 220 having already been affixed to the chain assembly 57 by the use of rivets 65 attached through the lined up holes 230 and 59. In FIG. 6B the back panels 500 have yet to be affixed.

In the illustrated embodiment, each of the windlocks 60 is affixed to an adjacent endlock 61 by a bolt 67. The connection maintains the slats in engagement, while allowing the slats to rotate as the door moves between open and closed positions.

Figure 7A:
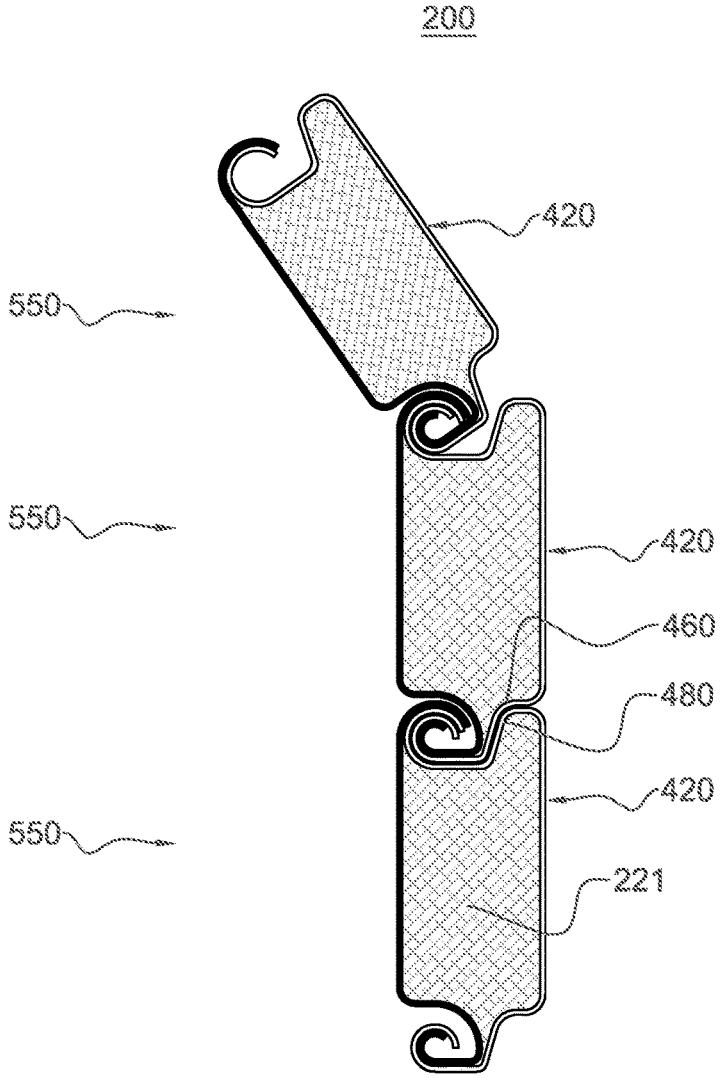
FIGS. 7A-7C show components of a double side profile door in accordance with an aspect of the present invention.
Figure 7C:
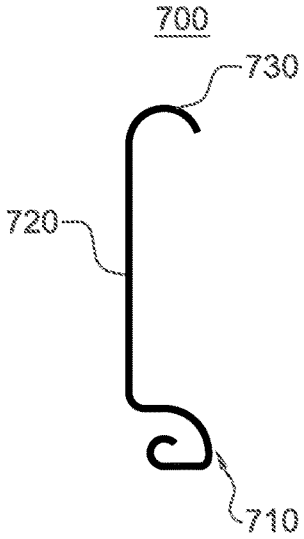
Figure 7B:
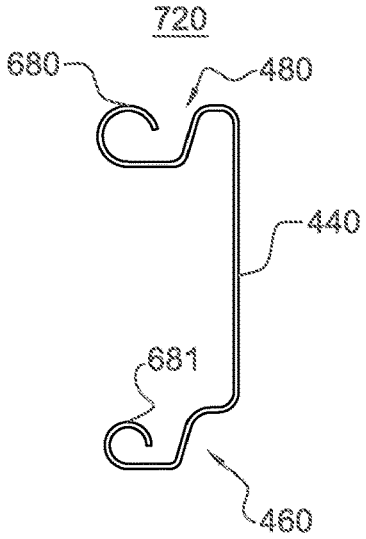

FIGS. 7A to 7C show components of door 200 having slats of a double offset and double slat profile. That is, each slat is formed from not only a front panel, in this case double offset front panel 420, but also from a back panel 700.

FIG. 7A is a view of three exemplary interconnected double offset double slat profile panel slats 550 of door 200. In this embodiment, each slat profile 550 has a double offset front panel 420 forming the front, i.e., outward facing, portion of the double offset double slat profile panel slat 550, and a back panel 700, forming the back, i.e., rearward facing, portion of the double offset double slat profile panel slats 550.

As can be seen in the figure, to form each double offset double slat profile panel slat 550, a double offset front panel 420, shown in isolation in FIG. 7B, is backed with a respective back panel 700, shown in isolation in FIG. 7C, each of which engages its corresponding front panel. FIG. 7A shows how double offset front panels 420 connect to one another, and to corresponding back panels 700, to form a representative portion of a double offset double slatted door 200.

Each double offset front panel 420, shown isolated in FIG. 7B, comprises a long side 440, and, forming the bottom and the top of the double offset front panel 420, respectively, inwardly facing sides 480 and 460 each having a dip in their profile before forming an upper hook 680 and an lower hook 681, respectively.

As can be seen best from an examination of the double offset front panel 420 of the middle double offset double slat profile panel slat 550 in FIG. 7A, the lower hook 681 of each double offset front panel 420 is configured to engage a corresponding upper hook 680 of the front panel below it. Thus, as can be seen in FIG. 7A, the lower hook 681 of the middle exemplary double offset front panel 420 engages a corresponding upper hook 680 of the immediately-below like panel. Conversely, the upper hook 680 of each front panel is configured to engage the lower hook 681 of the immediately-above like panel.

As discussed above, a difference between a single slatted door and a double slatted door is that the front panels not only engage with adjacent front panels, but also with their respective back panel 700. Also, as will be discussed below, this combination of upper hooks of each double offset double slat profile panel slat 550 engages a combination of lower hooks of each double offset double slat profile panel slat 550.

The back panel 700 is shown isolated in FIG. 7C. Each back panel 700 includes a lower hook 710, a long portion 720, and a retaining hook 730. As can be seen in FIG. 7A, for each double offset double slat profile panel slat 550, the interconnected top hooks 680 and 730 are connected to one another and to the interconnected bottom hooks 460 and 710 of the double offset double slat profile panel slat 550 immediately above.

As discussed above, each double sided slat can optionally have an insulation core 221. While this configuration has certain advantages, for example an implementation of insulation or fireproofing, it is not a necessary element of the present invention.

When the upper hook 680 of a slat 420 engages the lower hook 681 of an adjacent slat 420, the offset side 480 and the offset side 460 nestle into one another, as can be seen, for example, at the top of the lowest slat 420 in FIG. 7A. When nestled together, the respective profiles of the offset side 480 and the offset side 460 form a reinforcing structure that absorbs force impacting the front of the door, to make it much more likely that the adjacent slats will not disengage from one another, and to divert the force from the impact along the lateral direction, i.e., towards the ends of the slats.

As discussed above, the member formed by the connection structures, e.g., the engaged hooks between slats, or the recessed profile slats, in each of the above embodiments can, in certain embodiments form a lateral reinforcement impact distribution structure. According to another aspect of the present invention, another structure for providing lateral reinforcement impact force distribution may be realized by utilizing one or more force-distributing inserts 802. Such force-distributing inserts 802 can be used with conventional door slats (as shown in the illustrative examples of FIGS. 8A-8E), or may be used in addition to the structures formed by the hook or offset profile panels according to above-described aspects of the present invention.

Figure 8A:
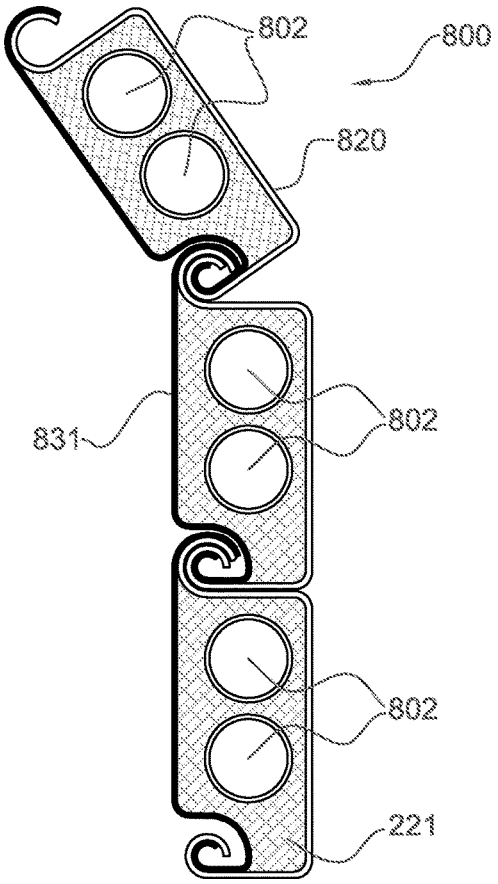
FIGS. 8A-8C show components of a double slat profile door in accordance with another aspect of the present invention that includes stiffening inserts.

FIG. 8A is a cross-sectional view of three exemplary interconnected reinforced double slat profile panel slats 800 of a door 10. In this embodiment, each double slat profile slat 800 has, arranged therewithin, one or more force-distributing inserts 802, (two are preferably shown). In the illustrated embodiment, the inserts are shown in the form of rods extending along the direction of the longitudinal extent of each slat. However, the invention is not limited to this particular embodiment and other types of insert that can distribute force could be used instead or in addition. Although the inserts 802 are illustrated in this embodiment with respect to a double slatted door, they may also be used in a single slatted door, which would, in such a case be the same as shown in FIG. 8A but would simply not including the rear slat panel.

Figure 8C:
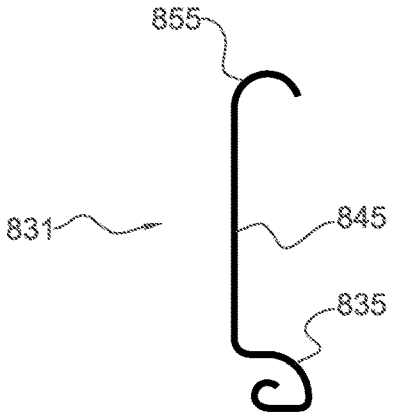
Figure 8B:
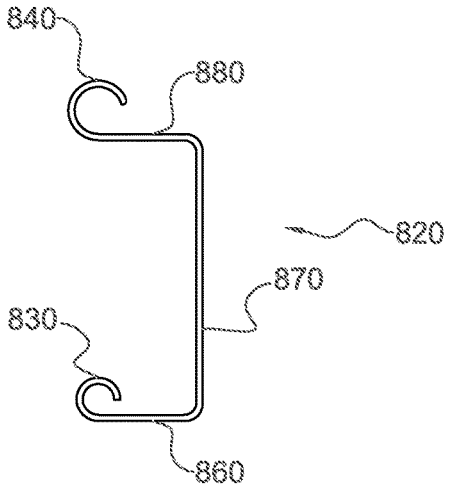

It is noted that the in FIGS. 8A-8B, the slats illustrated are conventional slats having neither the turned back portion 33 in the upper hook of a retaining hook front panel according to one aspect of the present invention, nor the inwardly facing offset sides 46 and 48 of the double offset front panel slat 42 in accordance with another aspect of the present invention. This is to illustrate that a door using the force-distributing inserts 802 works with either conventional slats or slats in accordance with aspects of the present invention. In FIG. 8A, double slat profile panel slats 800 each have a front panel 820 forming the front, i.e., outward facing, portion of the double slat profile slat 800, and a back panel 831, forming the back, i.e., rearward facing, portion of the double slat profile slat 800.

Figure 10A:
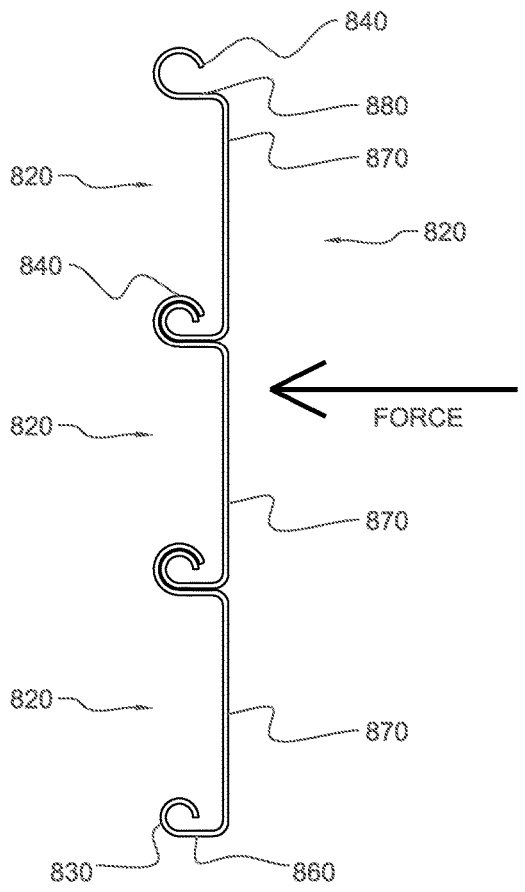
FIG. 10A PRIOR ART
FIGS. 10A and 10B show the effect of impacting force on a door made of conventional door slats.
Figure 10B:
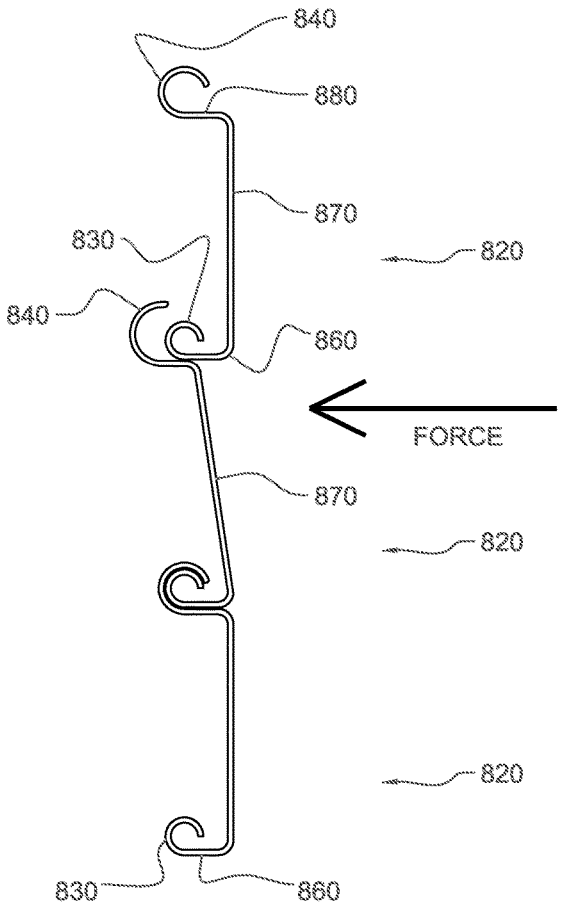
FIG. 10B PRIOR ART

In FIG. 8A, the front panels of the slats connect to one another vertically in a similar manner as in conventional slats shown in FIGS. 10A and 10B discussed above in the background. However, in FIG. 8A, the conventional front panels are connected to conventional rear panels to form conventional double panel slats.

With regard to the conventional front panels 820, each front panel 820, shown isolated in FIG. 8B, comprises a long side 870, inwardly facing sides 860 and 880, forming the bottom and the top of the front panel 820, respectively, a lower hook 830 and an upper hook 840. As can be seen best from an examination of the front panel 820 of the middle double slat profile panel slat 800 in FIG. 8A, the lower hook 830 of each front panel 820 is configured to be able to engage a corresponding upper hook 840 of the below adjacent panel. Conversely, the upper hook 840 of each front panel is configured to engage the lower hook 830 of the above adjacent panel 820.

As discussed above, in such a double slatted door, the front panels 820 not only engage with adjacent front panels 820, but also with their respective back panels 831. Also, as will be discussed below, this combination of upper hooks of each double slat profile panel slat 800 engages a combination of lower hooks of each double slat profile panel slat 800.

The back panel 831 is shown isolated in FIG. 8C. Each back panel 831 includes a lower hook 835, a long portion 845, and a hook 855. As can be seen in FIG. 8A, for each double slat profile panel slat 800, the interconnected top hooks 840 and 855 are connected to one another and to the interconnected bottom hooks 830 and 835 of the double slat profile slat 800 immediately above.

Each double sided slat can optionally have an insulation core 221. While this configuration has certain advantages, for example an implementation of insulation or fireproofing, it is not a necessary element of the present invention.

Figure 8D:
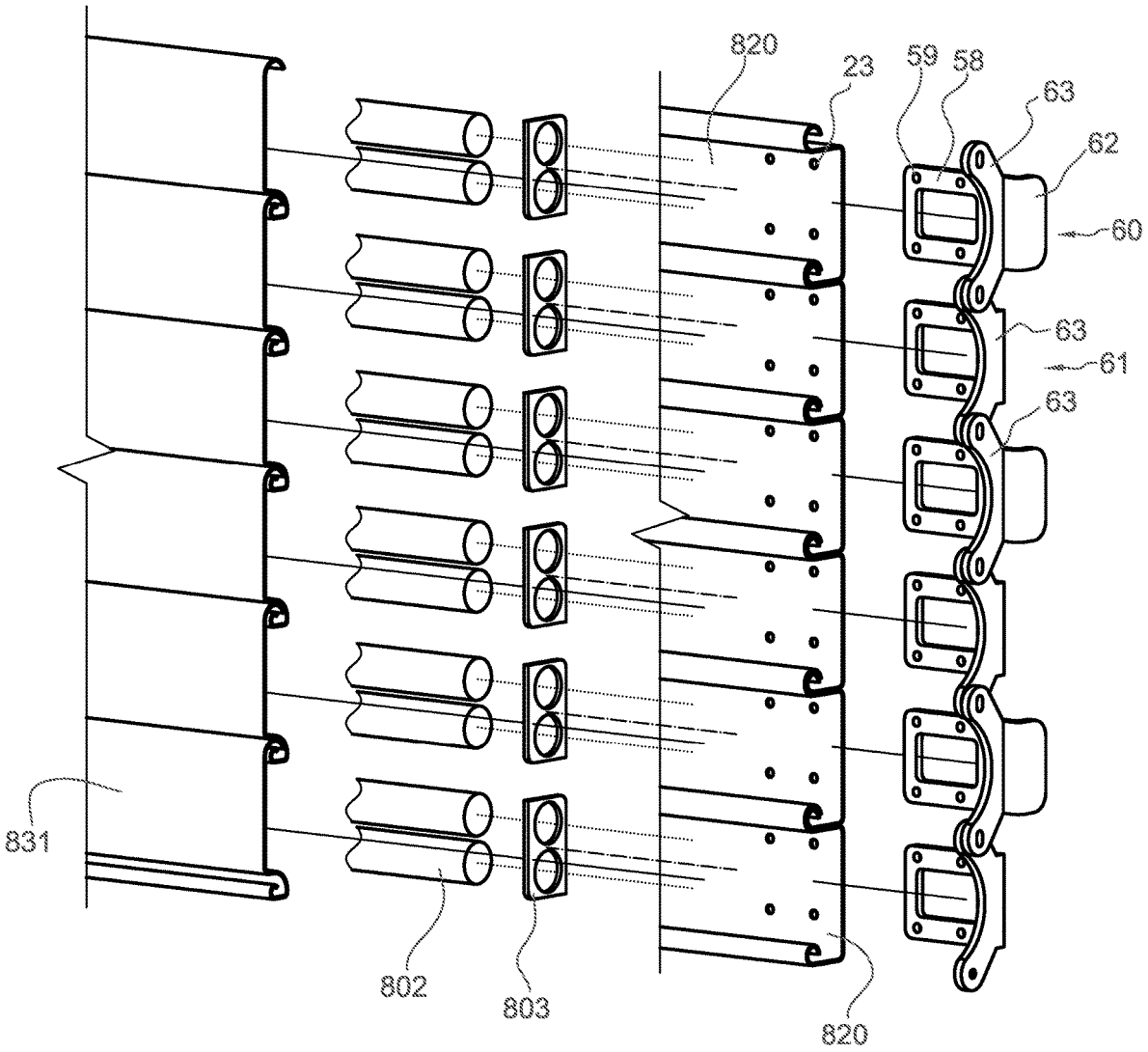
FIGS. 8D and 8E are exploded views of a double side profile door engaging with a chain assembly in accordance with another aspect of the present invention.
Figure 8E:
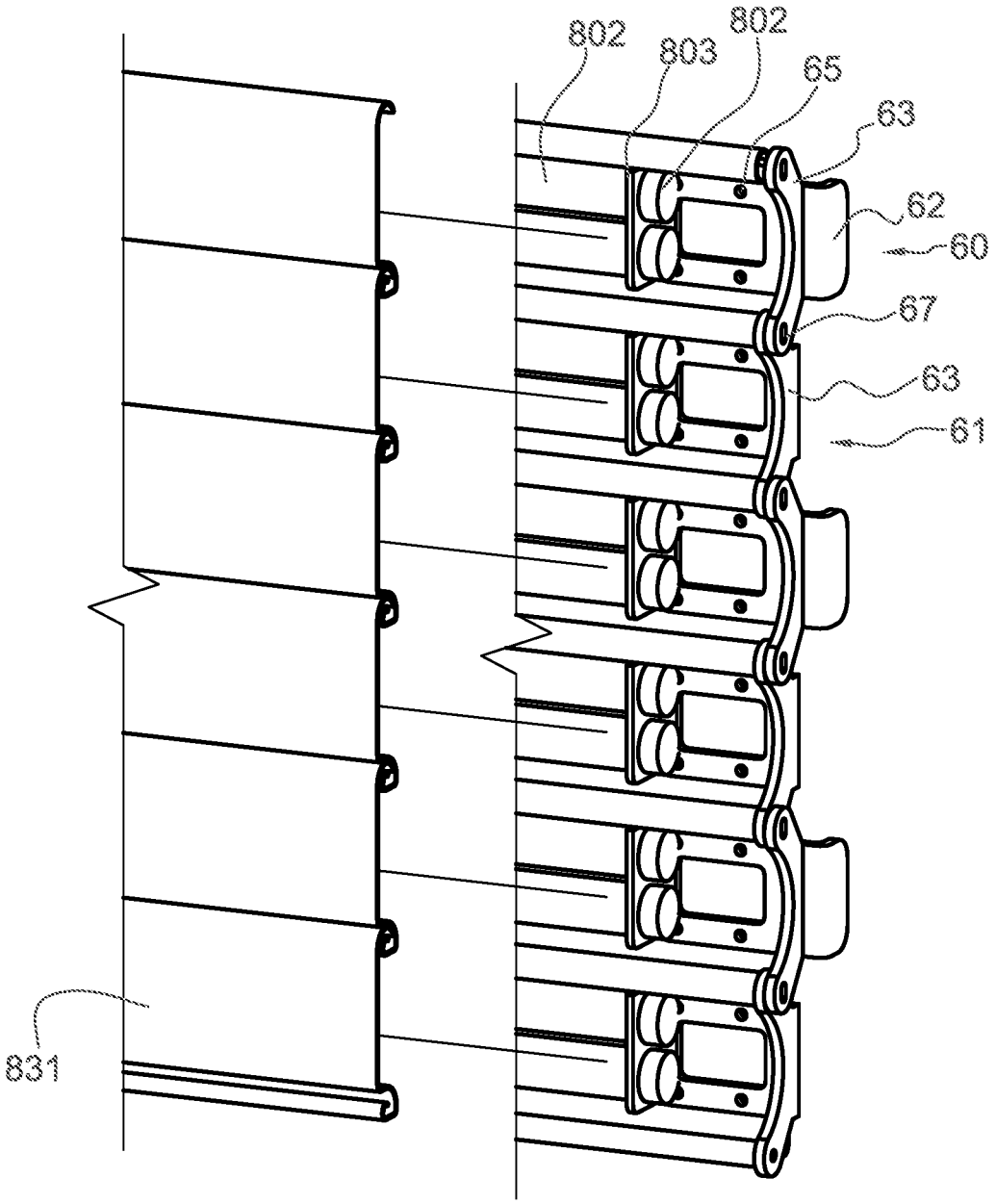

FIGS. 8D and 8E are exploded views corresponding to FIGS. 6A and 6B discussed above but with connecting slats 800, with force-distributing inserts 802 in the door 10. As can be seen, FIGS. 8D and 8E include features of the inserts 802 and the insert brackets 803. The chain assembly 57 remains substantially unchanged from FIGS. 6A and 6B and the reference numerals for that chain assembly 57 will be carried over to FIGS. 8D and 8E.

FIG. 8D is an exploded view of an end of the door 10, made up of a plurality of front panels 820, back panels 831, and a chain assembly 57 to which the end of the door 10 is to be connected. The ends of each front panel 820 have connecting holes 23 which, when the front panels 820 and the chain assembly 57 are lined up for connection, line up with rivet holes 59 in a rectangular portion 58 of each windlock 60 and each endlock 61. As discussed above, the main difference between an endlock 61 and a windlock 60 is the presence, in the each windlock 60, of windlock wing member 62. The windlock wing member 62 engages the railing of the guide track 14 to prevent bowing of the door 10 from causing the door to disconnect from the railing.

Also visible in FIG. 8D are the inserts 802 and the insert brackets 803. The inserts 802, which each engage with one or more portions of a corresponding door slat, provide a stiffening effect to the door and function to absorb, distribute and redirect impact transverse to the direction of lateral extension of the slatted door to the direction of lateral extension of the door. The insert brackets 803 are affixed within the door by passing through holes in the insert brackets 803.

FIG. 8E is an exploded view of a partially assembled double slatted door, with the front panels 820 having already been affixed to the chain assembly 57 by the use of rivets 65 attached through the lined up holes 23 and 59. In FIG. 8B the back panels 831 have yet to be affixed.

Each of the windlocks 60 is affixed to an adjacent endlock 61 by a bolt 67. The connection is tight enough to maintain the structural integrity of the door 10, while still allowing the door slats to go from being flat, to being curved, as in a rolled up position of the door.

As can be seen in FIG. 8E, the inserts 802 in this configuration, extend through the holes of the insert brackets 803. Preferably, the inserts are inserted through an insert bracket of an assembled chain assembly 57 on one side of the door, followed by placement a complementary chain assembly 57 at the other end of the door. This allows for easy installation of the inserts 802. The inserts 802 may be positioned directly against front panel 820 or simply proximate to the front panel. In either case, the positioning is such that an impact force to the front panel 820 of a subject slat will be transferred to the inserts 802 of that subject slat to be directed along the length of the inserts, thereby dissipating the impact force.

Figure 9:
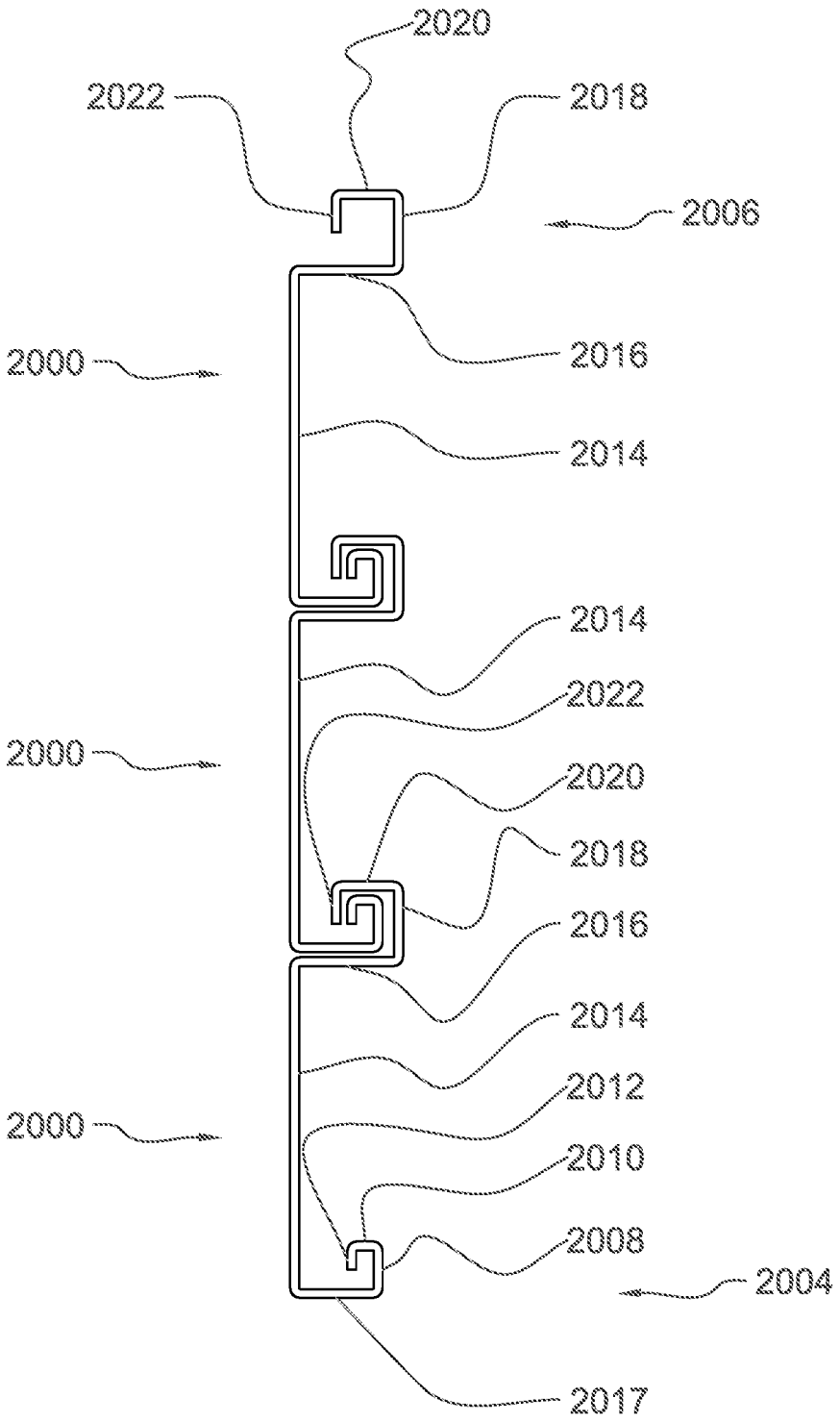
FIG. 9 is a section view of a portion of a second single side profile door in accordance with another aspect of the present invention with a right angle slat feature.

FIG. 9 is a cross-sectional view of three exemplary interconnected "squared-off" panel slats 2000 of a door 10. In this embodiment, the slats 2000 form the front, i.e., outward facing, portion of a single-side profile door. FIG. 9 illustrates three representative squared-off panel slats 2000, each in a flat configuration.

As can be seen from FIG. 9, each panel slat 2000 comprises a front face 2014, inwardly facing sides 2017 and 2016, formed the bottom and the top edges of the slat 2000, respectively, a lower hook 2004 and an upper hook 2006. Each lower hook 2004 has a J-hook shaped portion extending from the end of the inwardly facing side 2017. The J-hook shaped portion of the lower hook 2004 has an upwardly extending side 2008, a horizontally oriented portion 2010, extending from the upper end of the side 2008 and, extending downwardly from portion 2010, a downwardly extending portion 2012, from the end of portion 2010. Thus, the lower hook 2004 is made up of portions together forming squared-off angles so that the last portion 2012 of the lower hook 2004 forms a hook face that extends down toward the bottom of the slat 2000, the last portion 2012 forming a hook face that is substantially parallel to the front face 2014.

Each upper hook 2006 also has a wider J-hook shaped right angled portion extending from the end of the inwardly facing side 2016. The J-hook shaped portion of the upper hook 2006 has an upwardly extending side 2018, a horizontally oriented portion 2020, extending from the upper end of the side 2018 at a squared off region and, extending downwardly from portion 2020, a downwardly extending portion 2022, at a squared-off region from the end of portion 2020. Thus, the upper hook 2006 is made up of portions together forming squared regions so that the last portion 2022 of the upper hook 2006 forms a hook that faces down toward the bottom of the slat 2000, so that the last portion 2022 of the upper hook 2006 forms a hook face that extends down toward the bottom of the slat 2000, the last portion 2022 forming a hook face that is substantially parallel to the front face 2014.

As can be seen best from an examination of the middle slat 2000, the lower hook 2004 of each slat 2000 is configured to engage a corresponding upper hook 2006 of the below adjacent slat. Conversely, the upper hook 2006 of each slat is configured to engage the lower hook 2004 of the adjacent slat.

In an advantageous feature in accordance with an aspect of the present invention, when the slats are connected to adjacent slats, the right angled portions of the relatively narrower J-hook shaped portion of the lower hook 2004 nestle in the space formed by the squared-off portions of the relatively wider J-hook shaped portion of the upper hook 2006.

Due to this nestled configuration, in the presence of impact to the front of door, the force into the door is prevented from dislodging the slats from one another, and the force is distributed along the length of the slats. In contrast, a door formed conventionally without the nestled right angled portions would be more likely to become disengaged with the adjacent slat when impacted from the front of the door.

In all of the foregoing embodiments, the various shapes of the slats can be roll formed, bent or extruded depending on the material used. Suitable material may include steel, stainless steel, aluminum, plastic, or any other material readily known to one of ordinary skill in the art. The thickness of the slats will vary depending on the material used and the environment in which the door is utilized.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A door assembly for covering an opening defined by at least one structural element of a building, the door assembly comprising:

a shutter roller positioned proximate the opening and rotatable about an axis of rotation;

a drive mechanism configured to rotate the shutter roller about the axis of rotation;

a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door;

a guide rail assembly positioned at each side of the opening and extending along the direction of travel of the door;

a plurality of end members each attachable to an end of a corresponding slat; and at least one stiffening insert affixed to, and positioned proximate, an inner side of the outward face, and arranged in a direction along the length of the at least one slat, wherein in the end members, insert brackets are provided, each having at least one opening to accept and secure one end of a respective stiffening insert, and wherein the at least one stiffening insert forms a lateral reinforcement impact distribution structure configured to distribute and redirect an impact force applied to one or more of the slats of the door in a direction substantially along the length of said one or more slats.

2. The door assembly according to claim 1, wherein each end member at least partially overlaps with an adjacent end member.

3. The door assembly according to claim 1, wherein each end member at least partially overlaps with, and is connected to, an adjacent end member.

4. The door assembly according to claim 1, wherein the door is a single side profile door made up of a plurality of front panel slats.

5. The door assembly according to claim 4, wherein each front panel slat comprises an upper hook and a lower hook, wherein the lower hook of each slat is configured to engage a corresponding upper hook of the below adjacent slat, and wherein the upper hook of each slat is configured to engage the lower hook of the above adjacent slat.

6. The door assembly according to claim 5, wherein the door is a double side profile door and wherein each slat of the door comprises a front panel and an associated back panel.

7. The door assembly according to claim 6, wherein:

each front panel comprises the lower hook and the upper hook, and each back panel comprises a back panel lower hook and a back panel upper hook, the lower hook of each front panel being configured to engage a corresponding upper hook of the front panel of the below adjacent slat, and the upper hook of each front panel being configured to engage the lower hook of the front panel of above adjacent slat, the upper hook of each front panel being configured to engage the back panel upper hook of the corresponding back panel, the lower hook of each front panel being configured to engage the back panel lower hook of the corresponding back panel, the engaged lower hooks of each slat of the double side profile door engages the engaged upper hooks of a below adjacent double profile slat, and the engaged upper hooks of each slat of the double side profile door engages the engaged lower hooks of an above adjacent double profile slat.

8. A door assembly for covering an opening defined by at least one structural element of a building, the door assembly comprising:

a shutter roller positioned proximate the opening and rotatable about an axis of rotation;

a drive mechanism configured to rotate the shutter roller about the axis of rotation;

a flexible door having an outward face and windable on and off the shutter roller such that the flexible door is movable between retracted and extended positions by operation of the drive mechanism, the flexible door having a plurality of interconnected slats, each having two ends, a first edge and a second edge, and each being arranged along a direction perpendicular to a direction of travel of the door, wherein when a first slat is engaged with a second adjacent slat, portions of the first and second adjacent slats engage one another;

a guide rail assembly positioned at each side of the opening and extending along the direction of travel of the door;

a plurality of end members each attachable to an end of a corresponding slat, each of the end members has an anchor affixable to an end of one of the slats, and a force dampener offset from said anchor, each force dampener at least partially overlapping a force dampener of an adjacent end member at a spacing to absorb shock applied to one or more of the slats of the door and distributing said force in a direction substantially along the direction of travel of the door; and at least one stiffening insert affixed to, and positioned proximate, an inner side of the outward face, and arranged in a direction along the length of at least one slat of the plurality of interconnected slats, wherein the at least one stiffening insert forms a lateral reinforcement impact distribution structure configured to distribute and redirect an impact force applied to one or more of the slats of the door in a direction substantially along the length of said one or more slats.

9. The door assembly according to claim 8, wherein the overlapping portions of the force dampeners are affixed to one another.

10. The door assembly according to claim 8, wherein the first edge and second edge each have a hook portion terminating in a hook face, said hook face being one of substantially parallel to, and forming an acute angle with, the outward face of the door, wherein at least when a first slat is connected at the hook portion of its first edge with the hook portion of the second edge of an adjacent slat, the first and adjacent slats engage along their edges to form a reinforcement impact distribution structure extending laterally along the length of the slats, and wherein the impact distribution structure is configured to:

(a) rotatably secure the first and second slats to one another, and (b) direct an impact force applied to the outward face of the door in a direction substantially along the length of said one or more slats.

11. The door assembly according to claim 8, wherein the first edge of each slat is configured as a protrusion and the second edge of each slat is configured to have a recess such that when the upper edge of a slat is engaged with the lower edge of an adjacent above slat, the protrusion is received in the recess, and wherein said protrusion and recess form a reinforcement impact distribution structure extending laterally along the length of the slats.

* * * * *